US007009121B2

(12) United States Patent
Hochgesang et al.

(10) Patent No.: US 7,009,121 B2
(45) **Date of Patent: *Mar. 7, 2006**

(54) KEYBOARD, ESPECIALLY FOR ELECTRONIC PAYMENT TERMINALS, AND KEYPAD

(75) Inventors: Gerhard Hochgesang, Bad Neustadt (DE); Klaus Schmoeger, Bad Neustadt (DE); Dieter Weber, Stockheim (DE)

(73) Assignee: Preh-Werke GmbH & Co. KG, Bad Neustadt a.d. Saale (DE)

( * ) Notice: Subject to any disclaimer, the term of this patent is extended or adjusted under 35 U.S.C. 154(b) by 257 days.

This patent is subject to a terminal disclaimer.

(21) Appl. No.: 10/419,819

(22) Filed: Apr. 22, 2003

(65) Prior Publication Data

US 2004/0016628 A1 Jan. 29, 2004

Related U.S. Application Data

(60) Provisional application No. 60/376,834, filed on May 2, 2002.

(30) Foreign Application Priority Data

Apr. 25, 2002 (DE) ..... 102 18 442

(51) Int. Cl.
*H01H 9/00* (2006.01)

(52) U.S. Cl. ..... 200/5 A; 200/314; 200/317; 361/680

(58) Field of Classification Search ..... 200/5 A, 200/310–317, 517, 344, 345; 400/472–474, 400/489; 341/20, 22; 345/166, 173, 168; 361/678, 680

See application file for complete search history.

(56) References Cited

U.S. PATENT DOCUMENTS

| | | | | | |
|---|---|---|---|---|---|
| 5,430,263 | A | * | 7/1995 | English et al. | 200/5 A |
| 5,510,953 | A | * | 4/1996 | Merkel | 361/680 |
| 5,711,588 | A | | 1/1998 | Rudisill | |
| 5,865,546 | A | * | 2/1999 | Ganthier et al. | 400/489 |
| 6,489,576 | B1 | * | 12/2002 | Ito et al. | 200/310 |
| 6,580,043 | B1 | * | 6/2003 | Spratte | 200/517 |
| 6,609,805 | B1 | * | 8/2003 | Nelson | 362/30 |
| 6,670,565 | B1 | * | 12/2003 | Hanahara et al. | 200/314 |
| 6,743,993 | B1 | * | 6/2004 | Clark et al. | 200/314 |

FOREIGN PATENT DOCUMENTS

| | | |
|---|---|---|
| DE | 690 09 901 T2 | 2/1991 |
| DE | 693 21 521 T2 | 12/1993 |
| DE | 297 11 813 U1 | 10/1997 |
| DE | 196 41 786 A1 | 4/1998 |
| DE | 198 11 728 C1 | 11/1999 |
| DE | 100 34 346 A1 | 2/2002 |
| EP | 0 685 860 A1 | 12/1995 |
| GB | 2 364 275 A | 1/2002 |
| WO | 98/26438 A1 | 6/1998 |
| WO | WO 01/20628 A1 | 3/2001 |

* cited by examiner

*Primary Examiner*—Michael A. Friedhofer
(74) *Attorney, Agent, or Firm*—Birch, Stewart, Kolasch & Birch LLP

(57) ABSTRACT

A one-piece keyboard housing in a simple but compact manner is provided by using an internal gas pressure injection molding process (air mold process). With this process, the keyboard housing can be formed as a one-piece molded part with recesses and cavities. The cavity serves to reduce weight, and the process itself improves stability within the keyboard housing. The molded part is formed of a traylike first housing shell, in which a keypad can be mounted, and a second housing shell with recesses that joins the first housing shell in an n-shape.

18 Claims, 3 Drawing Sheets

KEYBOARD, ESPECIALLY FOR ELECTRONIC PAYMENT TERMINALS, AND KEYPAD

This nonprovisional application claims priority under 35 U.S.C. § 119(a) on Patent Application No. DE 102 18 442.9 filed in Germany on Apr. 25, 2002, and under 35 U.S.C. 517 119(e) on Provisional Application 60/376,834 filed on May 2, 2002, which are both herein incorporated by reference.

BACKGROUND OF THE INVENTION

1. Field of the Invention

The present invention relates to a keyboard and a keypad, especially for an electronic payment terminal.

2. Description of the Background Art

Known from DE 100 34 346 A1 is a generic keyboard for an electronic payment terminal with a one-piece keyboard housing. The housing has a top and a bottom housing shell which join together in an essentially S-shaped manner. The housing is an injection molded plastic part. In the top housing shell, a keypad is held at an angle by diagonals. Arranged beneath the keypad, for example, are keyboard electronics. The bottom side or surface of the top housing shell is built flat relative to an imaginary support surface. Electrical connections for auxiliary assemblies extend into the top housing shell from the recesses in the bottom housing shell adjoining this surface.

DE 297 11 813 U1 discloses an illuminated keyboard for a computer, wherein at least one light source is arranged between the key surfaces and the base plate of the keyboard. Suggested light sources are a planar light source or multiple thin light pipes, wherein provision is also made for placement of a light-emitting diode beneath each key surface.

A light guide for a keyboard system is described by DE 693 21 521 T2 (EP 0575 767 B1). The light guide extends within a key, collects the light from a light source located therebelow, and transports it to the surface of the key where the light is diffusely scattered to uniformly illuminate keys and/or rectangles.

DE 690 09 901 T2 (EP 90 307 620 B1) also describes a light guide for illuminating a keypad, here for a mobile telephone. The light guide is embodied as a transparent plate through which the light is conducted beneath the keys of the keypad.

SUMMARY OF THE INVENTION

It is therefore an object of the present invention to provide an easily manufactured keyboard that is designed not only to be easily assembled and serviced, but also to have improved user-friendliness. Another object is to specify a simply constructed keypad.

Starting from the concept of a compact one-piece housing, the invention is based on the idea of implementing a simpler design thereof. The basic structure of the housing includes a first (front) open housing shell and a second (rear) open housing shell that joins thereto in an n-shape. The first housing shell has a traylike recess to accommodate a keypad and a u-shaped border surrounding the recess that is preferably hollow. The bottom surface of the recess in the first housing shell terminates at an imaginary support surface of the housing. For angled mounting of the keypad, provision is made for the bottom surface of the recess to be designed to increase in thickness toward the rear housing shell.

The second housing shell serves in particular to accommodate various electronic and auxiliary assemblies, for which purpose the second housing shell preferably has recesses or indentations of various depths, whereby provision is made for the installation of a card reader with electronics in the second housing shell. Alternatively, however, a slot, for example lateral, can be provided in the molded part or in the first housing shell to accommodate a card reader.

The housing itself is characterized by simple lines.

In practice, it has been discovered that internal gas pressure injection molding (air mold process) is ideally suited for realizing a housing of this type. The process steps and implementation are described in references including "PRAXIS-Kunststoffverarbeitung 6," published in 1995 by Hüttigverlag, Heidelberg (ISBN: 3-92941-13-2). In particular, the housing can be executed as a one-piece molded part with recesses and cavities using this process. The cavities serve to reduce weight, and the process itself improves stability within the keyboard housing and also reduces keyboard cost.

In a further embodiment of the invention, the keypad can be illuminated for easier operation and now has only a printed circuit board as the support plate for the keypad, a transparent or translucent contact mat located thereupon, and a transparent or translucent guide frame that functions as a light guide for at least one transparent or translucent keycap. However, it is also possible for the guide frame to be opaque. This design results in reduced weight and compact construction.

In a further embodiment, light that is coupled into the light guide can also be introduced into the housing produced, for example, by internal gas pressure injection molding, for which purpose the housing is then likewise made of transparent or translucent plastic.

The symbols on the transparent or translucent keys are produced by laser marking of the painted surface or are injected as inlays in the tool or are produced in a multicomponent injection process.

Further scope of applicability of the present invention will become apparent from the detailed description given hereinafter. However, is should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
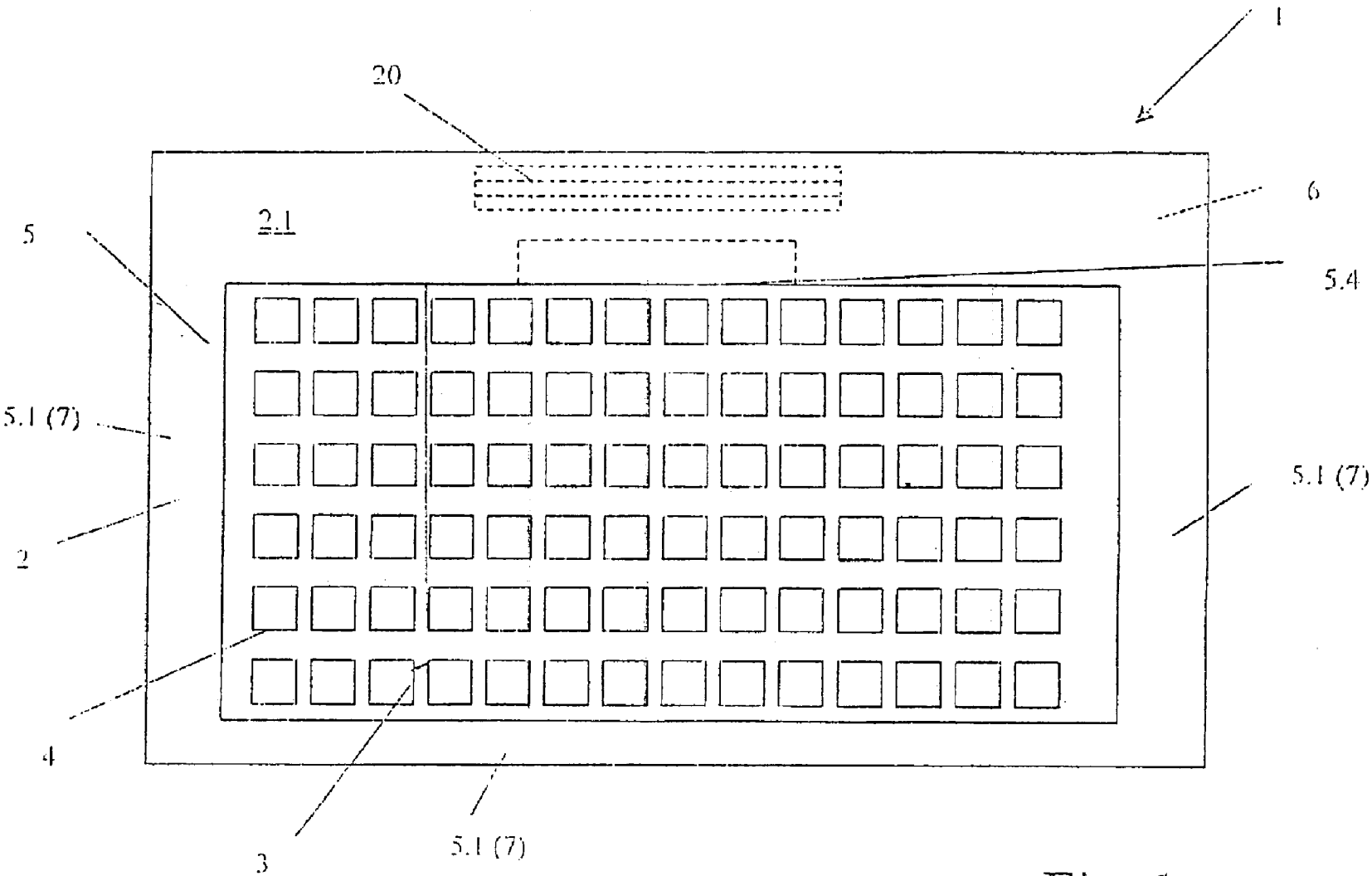
FIG. 1 is a top view of a keyboard according to a preferred embodiment of the invention.

FIG. 1 shows a keyboard 1, having a keyboard housing 2 and a keypad 3 with keys 4, in a top view. The keyboard housing 2 is a plastic, preferably opaque, and is embodied as a one-piece molded part. Indicated in the upper region 2.1 of the housing 2 is a card reader 20 that is taken into account during manufacture of the keyboard 1 when the latter is intended for a POS Point of Sale) terminal.

Figure 2:
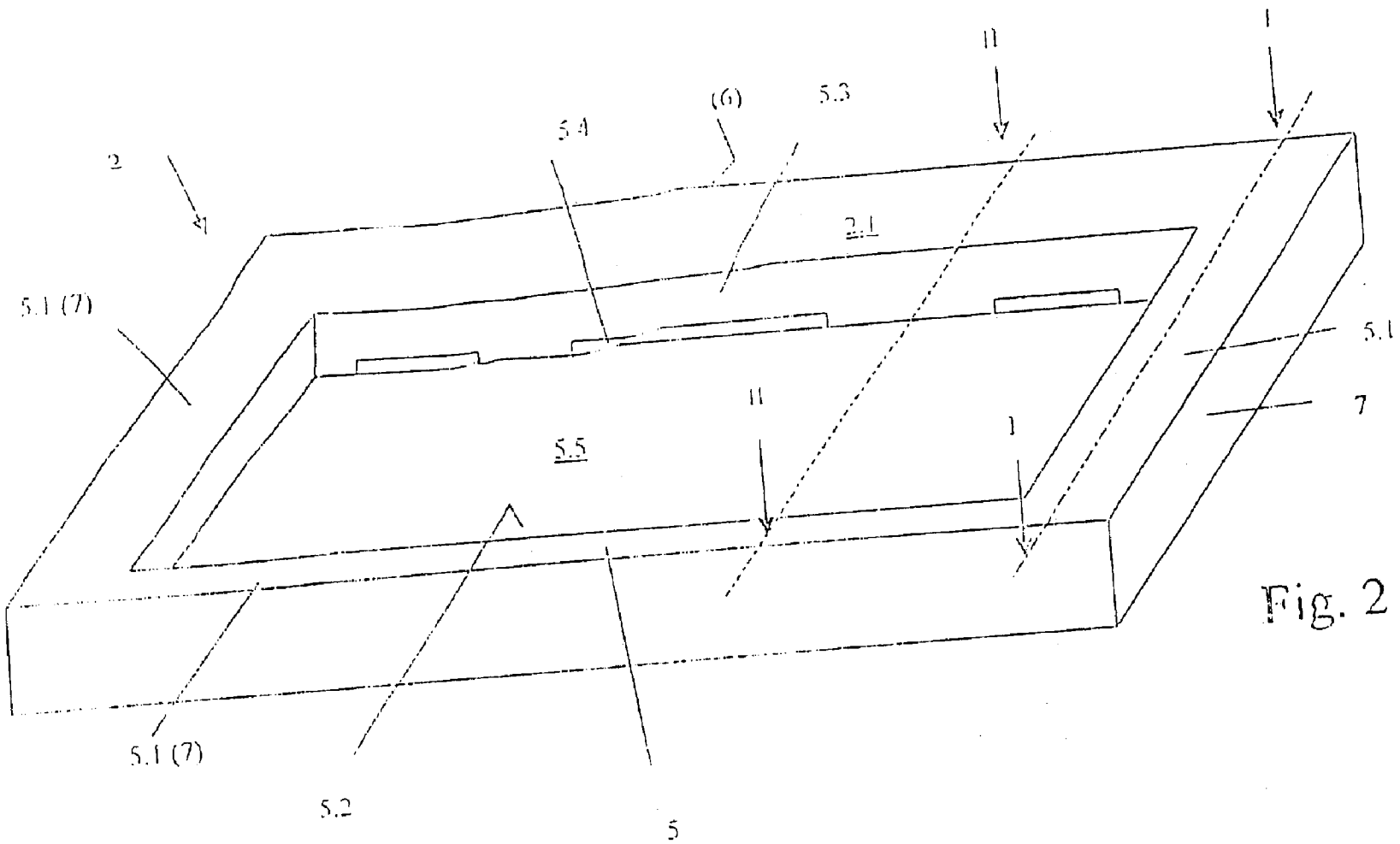
FIG. 2 is a perspective top view of the keyboard housing from FIG. 1, without the keypad.
Figure 3A:
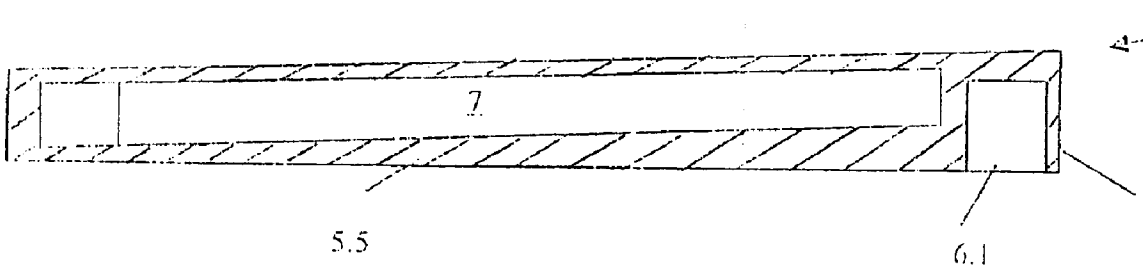
FIG. 3*a* is a cross-sectional view of the keyboard housing along the line I—I from FIG. 2.

FIG. 2 shows the keyboard housing 2 in a perspective view without the card reader 20 and without the keypad 3. The one-piece molded part includes a first, front open housing shell 5 and a second, rear open housing shell 6 (FIG. 3*a*, 3*b*) that joins thereto in an n-shape. The first housing shell 5 has a traylike recess 5.2 in which the keypad 3 is mounted. A remaining border 5.1 around the recess 5.2 of the first housing shell 5 is implemented as a hollow part or cavity 7, as shown in FIG. 3*a*. In the rear side 5.3 of the recess 5.2, there is preferably introduced a slot 5.4 that allows electrical connection of the keypad 3 with electronic assemblies (not shown) in the second housing shell 6.

Figure 3B:
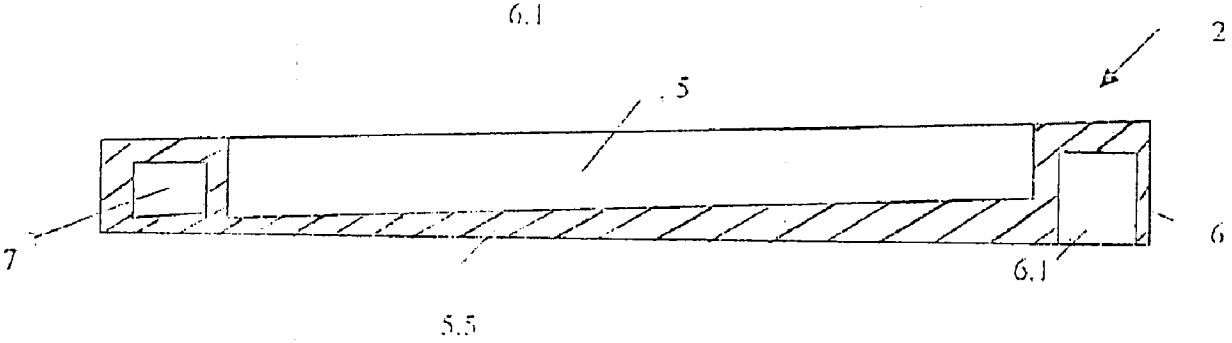
FIG. 3*b* is another cross-sectional view of the keyboard housing along the line II—II from FIG. 2.

FIG. 3*a* shows a cross-sectional view from FIG. 3 along I—I through the enclosed cavity 7, and FIG. 3*b* shows another cross-sectional view along II—II.

The bottom surface 5.5 of the recess 5.2 of the first housing shell 5 is preferably designed such that the keypad 3 supported in the first housing shell 5 is held at an angle in the keyboard housing 2. In addition to providing a preferred operating plane, the angled position of the keypad 3 is also advantageous in allowing moisture to run off. Moisture can be kept away from the keypad 3 by additional means which are not shown. Since the bottom side of the surface 5.5 preferably terminates flat against an imaginary support surface for the keyboard housing 2, provision is made for the cross-section of surface 5.5 to increase in thickness toward the second housing shell 6.

The second rear housing shell 6 is also clearly visible in both FIGS. 3*a* and 3*b*. As already described, it joins the first housing shell 5 in an n-shape. The electronic assemblies (such as the keyboard electronics) and auxiliary assemblies of the keyboard 1 can be incorporated in the hollow or recesses 6.1 of the n-shape. If a card reader 20 is provided in the upper region 2.1 of the keyboard housing 2, the keyboard housing 2 has in this region 2.1 at least one slot to guide the card.

Figure 4A:
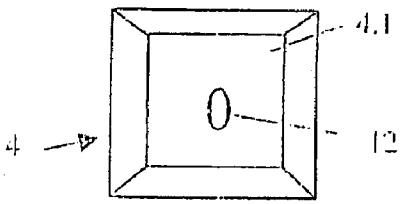
FIG. 4*a* is a top view of one of the keys from FIG. 4.
Figure 4:
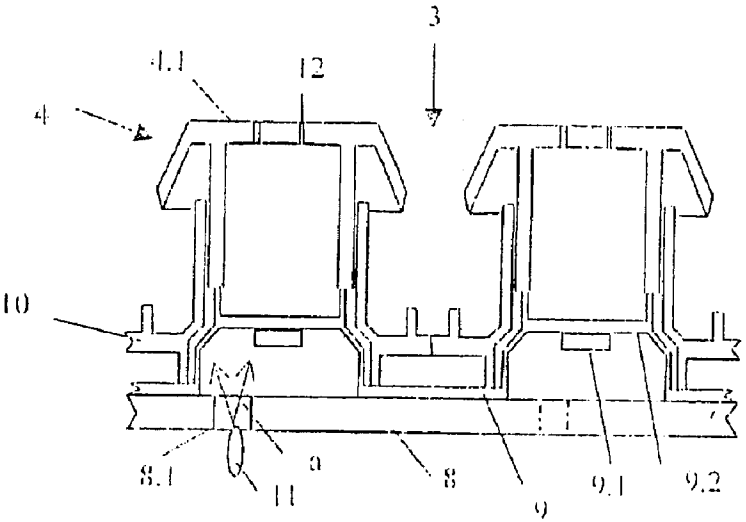
FIG. 4 is a detail view of the keypad from FIG. 1, with two keys.

The keypad 3 has, as shown in a detail view in FIG. 4, a printed circuit board 8 as the support plate, a contact mat 9 located thereupon, and a light guide 10, which functions as a support element for the keys 4. The contact mat 9 preferably is made of a translucent material and the light guide 10 preferably is made of a transparent material. The contact mat 9 has, conductive contacts 9.1 associated with the keys 4 that are attached to contact domes 9.2 and by which the keys 4 make contact with contacts on the printed circuit board 8. The keys 4 are spaced apart from the printed circuit board 8 by the contact domes 9.2. The contacts 9.1 are preferably round and have a cylindrical shape. In a further embodiment of the invention, the contact 9.1 can also be ring-shaped.

In order to couple light a from at least one light source 11 into the keys 4 or keycaps 4.1, the printed circuit board 8 has openings 8.1. The number of openings 8.1 in the printed circuit board 8 is a function of the level of illumination of the keypad 3 and the keycaps 4.1. In practice, however, provision is made in the preferred embodiments to provide each of the keys 4 with a separate light source 11 located thereunder.

The keycaps 4.1 are likewise made of translucent material. Digits and/or symbols 12, which can be illuminated, are located in the centers.

In an advantageous manner, the illumination can be dimmed by the keys 4 or key combinations, for which appropriate software is integrated in the key system or the keyboard electronics. Dimming can be stepwise or continuous.

Further modifications are also possible within the scope of the inventive concept.

For instance the cavity 7 or parts thereof can be omitted when the border 5.1 has a small cross-section and is thus thin-walled. As an alternative to the proposed solution, a lateral slot for insertion or swiping of a card which is not shown (magnetic stripe or chip card) can also be provided, in which case integration of the associated electronics is also taken into account. It is also possible to install the card reader 20 separately and outside of the keyboard housing 2. It is also self-evident that this keyboard is not limited to applications on POS electronic payment terminals. It can also be used as an input device for other computers or control consoles.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A keyboard comprising:

a one-piece keyboard housing for accommodating a keypad with keys, the keyboard housing including at least two open housing shells, the second housing shell joining the first housing shell at a top region of the keyboard housing forming an n-shape, wherein the first housing shell has a traylike recess for accommodating and mounting the keypad and has a u-shaped border surrounding the recess, which encloses a cavity within the first housing shell.

2. The keyboard according to claim 1, wherein a bottom surface of the traylike recess in the first housing shell rests flat against an imaginary support surface of the keyboard housing.

3. The keyboard according to claim 2, wherein the cross-section of the bottom surface increases in thickness toward the second housing shell when the keypad is mounted at an angle in the keyboard housing.

4. The keyboard according to claim 1, wherein electronic assemblies can be integrated in the second housing shell.

5. The keyboard according to claim 4, wherein at least one slot is placed in the first housing shell, by which the keypad in the first housing shell can be electrically connected to electronic assemblies in the second housing shell.

6. The keyboard according to claim 1, wherein a card reader is provided in an upper region of the keyboard housing.

7. The keyboard according to claim 1, wherein the keyboard housing is formed by internal gas pressure injection molding.

8. The keyboard according to claim 1, wherein the keypad further comprises:

a printed circuit board for use as a support plate;

a translucent or transparent contact mat; and a transparent, translucent or opaque light guide as a support element for the keys.

9. The keypad according to claim 8, wherein the printed circuit board accommodates keyboard electronics or parts thereof.

10. The keypad according to claim 8, wherein keycaps of the keys are made of translucent or transparent material having integrated symbols and/or digits.

11. The keypad according to claim 10, wherein the symbols are laser marked.

12. The keypad according to claim 8, wherein the keys are painted or are produced in a multicomponent or inlay process.

13. The keypad according to claim 8, wherein the printed circuit board has openings through which light from at least one light source is conducted.

14. The keypad according to claim 8, wherein light is conducted by the translucent or transparent contact mat and/or the light guide to keycaps for illuminating the keycaps.

15. The keypad according to claim 8, wherein light is guided directly or by a light guide into the keyboard housing for illuminating the keyboard housing.

16. The keypad according to claim 8, wherein the light can be dimmed by the keys or a key combination.

17. The keypad according to claim 16, wherein the dimming is stepwise or continuous.

18. A keypad for a keyboard having a keyboard housing, having keys and contacts associated therewith, the keypad comprising:

a light source for generating light;

a printed circuit board for use as a support plate;

a translucent or transparent contact mat; and a transparent or translucent light guide as a support element for the keys, wherein substantially all of the light from the light source is transmitted through the transparent or translucent light guide to the keys.

* * * * *